US008844068B2

(12) United States Patent
DeGooyer

(10) Patent No.: US 8,844,068 B2
(45) Date of Patent: Sep. 30, 2014

(54) SHOWER DRAIN ADAPTER

(75) Inventor: Lonnie C. DeGooyer, South Jordan, UT (US)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 13/224,113

(22) Filed: Sep. 1, 2011

(65) Prior Publication Data

US 2011/0308008 A1 Dec. 22, 2011

Related U.S. Application Data

(62) Division of application No. 11/498,537, filed on Aug. 2, 2006, now Pat. No. 8,060,956.

(60) Provisional application No. 60/705,139, filed on Aug. 2, 2005.

(51) Int. Cl.

| | |
|---|---|
| ***A47K 3/00*** | (2006.01) |
| ***E03F 5/04*** | (2006.01) |
| ***E03C 1/20*** | (2006.01) |

(52) U.S. Cl.

CPC ..... *E03C 1/20* (2013.01); *E03F 5/0408* (2013.01); *E03F 2005/0413* (2013.01); *E03F 5/0409* (2013.01); *E03F 2005/0414* (2013.01)

USPC ..... 4/613

(58) Field of Classification Search

CPC ..... A61H 35/00; A47K 3/40

USPC ..... 4/596–614

See application file for complete search history.

(56) References Cited

U.S. PATENT DOCUMENTS

| | | | |
|---|---|---|---|
| 1,782,737 | A | 11/1930 | Mahon |
| 2,222,807 | A | 11/1940 | Burr |
| 2,299,705 | A | 10/1942 | Bennett |
| 2,672,205 | A | 3/1954 | McDonald |
| 3,668,718 | A | 6/1972 | Cuschera |
| 3,744,065 | A | 7/1973 | Yavitch |
| 3,839,752 | A | 10/1974 | Brown et al. |
| 3,896,511 | A | 7/1975 | Cuschera |

(Continued)

FOREIGN PATENT DOCUMENTS

| | | |
|---|---|---|
| DE | 2035199 | 1/1972 |
| DE | 2315574 | 10/1974 |

(Continued)

OTHER PUBLICATIONS http://www.schluter.com; Schluter Systems Profile of Innovation; 8.2 Schluter—Kerdi-Drain; Mar. 23, 2005; 4 pages; printed in Canada.

(Continued)

*Primary Examiner* — Lori Baker

(74) *Attorney, Agent, or Firm* — Thorpe North & Western LLP

(57) ABSTRACT

A shower drain adapter configured to allow use of a bondable waterproof membrane with a shower pan drain system comprises a drain body and a lower mating flange extending from the drain body. The lower mating flange is operable to mate with an upper portion of a body of a shower pan drain installable on a waste pipe. An integrated bonding flange extends from the drain body and is operable to be sealably attached to a bondable waterproof membrane to provide a waterproof seal between the membrane and the adapter.

7 Claims, 4 Drawing Sheets

(56) References Cited

U.S. PATENT DOCUMENTS

| | | | |
|---|---|---|---|
| 4,067,072 | A | 1/1978 | Izzi |
| 4,092,745 | A | 6/1978 | Oropallo |
| 4,099,274 | A | 7/1978 | Emberson |
| 4,123,810 | A | 11/1978 | Oropallo |
| 4,146,939 | A | 4/1979 | Izzi |
| D260,170 | S | 8/1981 | Cornwall |
| D263,866 | S | 4/1982 | Messenger |
| D273,413 | S | 4/1984 | McMurray |
| 4,455,693 | A | 6/1984 | Cuschera |
| 4,562,602 | A | 1/1986 | Cuschera |
| 4,694,513 | A | 9/1987 | Kiziah |
| 4,883,590 | A | 11/1989 | Papp |
| 4,964,180 | A | 10/1990 | Harbeke |
| 5,216,767 | A | 6/1993 | Elmore |
| D346,433 | S | 4/1994 | Cooper |
| 5,333,432 | A | 8/1994 | Schluter |
| D379,493 | S | 5/1997 | Woods |
| 6,035,886 | A | 3/2000 | Kerr |
| 6,085,362 | A | 7/2000 | Huber |
| 6,212,709 | B1 | 4/2001 | Newton |
| 6,350,373 | B1 | 2/2002 | Sondrup |
| 6,381,775 | B1 | 5/2002 | Sondrup |
| D468,001 | S | 12/2002 | Teskey |
| 6,675,679 | B2 | 1/2004 | Dugan |
| D593,641 | S | 6/2009 | Plank |
| 2007/0056088 | A1 | 3/2007 | DeGooyer |
| 2007/0113329 | A1 | 5/2007 | Luk |
| 2007/0204399 | A1 | 9/2007 | DeGooyer |
| 2008/0229494 | A1 | 9/2008 | DeGooyer |
| 2009/0113621 | A1 | 5/2009 | DeGooyer |

FOREIGN PATENT DOCUMENTS

| | | |
|---|---|---|
| DE | 3442178 | 5/1986 |
| DE | 4000511 | 7/1990 |
| DE | 3907832 | 9/1990 |
| DE | 4013775 | 11/1991 |
| DE | 4206512 | 9/1993 |
| MX | 2008010910 | 9/2008 |
| WO | WO 2004/042155 | 5/2004 |
| WO | WO 2007/016672 | 2/2007 |

OTHER PUBLICATIONS

IKZ Haus Technik brochure Aug. 19, 1985; 1 page.

Schluter Systems; Schluter-Kerdi-Drain with Intergrated Bonding Flange for Bonded Waterproof Membranes; www.shcluter.com; 2004; 2 pages.

Shower Receptor Wood or Metal Studs; Schluter Systems; USA.

U.S. Appl. No. 13/179,720, filed Jul. 11, 2011; Lonnie C. DeGooyer.

U.S. Appl. No. 12/205,105, filed Sep. 5, 2008; Lonnie C. DeGooyer; office action issued Oct. 18, 2011.

U.S. Appl. No. 12/077,941, filed Mar. 20, 2008; Lonnie C. DeGooyer; notice of allowance issued Oct. 12, 2011.

U.S. Appl. No. 12/205,05, filed Sep. 5, 2008; Lonnie C. DeGooyer; office action issued Jan. 26, 2012.

U.S. Appl. No. 13/396,480, filed Feb. 14, 2012; Lonnie C. DeGooyer; office action dated Aug. 1, 2013.

SHOWER DRAIN ADAPTER

CROSS REFERENCE TO RELATED APPLICATIONS AND PRIORITY CLAIM

This application is a divisional of U.S. patent application Ser. No. 11/498,537, filed Aug. 2, 2006, which claims priority to U.S. Provisional Patent Application No. 60/705,139, filed Aug. 2, 2005, which are each hereby incorporated herein by reference in their entirety.

BACKGROUND OF THE INVENTION

1. Field of the Invention

The present invention relates generally to pipe fittings utilized in shower or bath installations. More particularly, the present invention relates to pipe fitting adapters utilized in tile shower installations.

2. Related Art

Until very recently, the construction of shower floors conventionally included at least five primary components, including, listed in ascending order: a shower subfloor (including a pre-sloped layer); a shower pan; a mortar bed; a shower drain; and a floor surfacing material (e.g., ceramic tiles). This type of installation utilizes a well-known, two-piece drain to which the shower pan is sealably attached beneath the mortar bed. The term "two-piece" drain is used because the drain typically includes at least two components that "sandwich" the shower pan between one another to clamp the shower pan to the drain. These five components are discussed in some detail below.

The subfloor is typically a concrete floor or a wood floor of the house or dwelling in which the shower is installed. The subfloor provides the support base upon which the other elements of the shower floor rest. In order for the shower pan to drain most effectively, the subfloor will primarily be slightly sloped toward the drain so that fluids on top of the pan will migrate or flow toward the drain. One of the common methods of achieving this slope is by "skim coating" or "floating" the subfloor with a thin layer of suitable mortar applied, in an appropriate slope, prior to installing the shower pan over the thin layer of mortar.

The shower pan is most often a relatively tough plastic sheet on the order of 30 to 40 mils in thickness. These types of shower pans are generally available in rolls of 4, 5 or 6 feet in width which are installed within the shower enclosure. Also, pre-fitted or pre-formed shower pans are offered by some manufacturers.

The mortar bed is generally formed from a sand and cement mixture that is installed over the shower pan as a damp, compactable, coarse material. The mortar bed material is often called a "dry pack" and has only enough water in it to hydrate the cement and make the mortar bed compactable. The mortar bed cures into a hard concrete base capable of supporting the overlaying tiles or other floor covering. Because it has a large proportion of sand, the mortar bed remains very porous and will readily absorb water after it has cured. The mortar bed typically varies in thickness from about ¾ of an inch to about 3 inches, depending upon the installation, and is generally sloped toward the center (or to the location where the drain is located) so that water will flow on the surface of the floor toward the floor drain.

Generally, the mortar bed serves two primary purposes: to provide slope to the floor surface so it will drain; and to provide a bedding surface for the overlying floor material (e.g., ceramic tiles) to rest upon and bond to. The mortar bed rests on top of the shower pan, with the entire installation relying upon the shower pan for waterproofing the floor of the shower. The mortar bed is itself very porous, contributing nothing to the waterproofing of the shower. In fact, if the mortar bed is not properly drained, it can actually create a waterproofing liability. The mortar bed quickly absorbs any water that contacts it and will hold a considerable amount of water until it becomes saturated, unless it is properly drained.

The drain component of the above-referenced shower assembly is generally at least a two-piece assembly that is designed to fulfill three primary purposes: to achieve a water-tight connection to the shower pan; to provide drainage to the mortar bed; and to drain the shower floor or other wet surface. This type of drain is often referred to as a "double seepage drain" or "double drainage drain." This is because it drains the floor surface while also allowing water to seep from the mortar bed into the drain through "weep holes" formed in sides of the drain adjacent the mortar bed. The weep holes are usually holes, grooves, slots or other openings formed through the drain collar, or occasionally in the drain neck.

The drain generally includes a collar that attaches to a drain flange of the drain to "sandwich" the shower pan between the collar and the drain, which creates a water-tight seal between the pan and the drain. The weep holes allow water from the mortar bed to drain through the collar and into the drain while the water on the top of the floor surface runs down through the top of the drain. It is a common practice for installers to place a pile of gravel or small pieces of broken tile around and above the weep holes located on the drain collar, prior to installing the mortar bed, to provide better access for free water flow from the mortar bed into the weep holes. The aggregate generally allows more surface area of the mortar bed to be drained and provides a highly porous substrate to allow fluid to flow freely to the weep holes.

While the shower pan liner-type of shower floor installation has been used for many years, a different type of assembly has recently become popular and involves the use of a bondable (or bonded) waterproof membrane. In general, a bondable waterproof membrane bonds directly to the mortar bed (or suitable equivalent) and protects the mortar bed (and any underlying structure such as the subfloor) from becoming saturated. While bondable waterproof membranes have become popular, the incorporation of bondable waterproof membranes in floor drain installations has required that drain fittings other than the conventional two-piece drains be developed. This is because conventional two-piece floor drains were designed to connect to shower pan liners below the mortar bed and so did not allow a secure, watertight connection to bondable waterproof membranes at the top of the drain assembly. For this reason, drain fittings with integrated bonding flanges were developed for use with bondable waterproof membranes.

Thus, when a shower installation is plumbed, one of two types of drains can be installed on the waste pipe by the plumber: the conventional, two-piece drain, or the relatively newly developed integrated bonding flange drain. As the type of drain that is installed on the waste pipe generally determines the type of waterproofing system used (e.g., shower pan vs. bondable waterproof membrane), a tile installer is often limited by the plumbing installed prior to the tile installer arriving at the job. If a bondable waterproof membrane installation is desired, and a two-piece drain was installed by the plumber, the tile installer has been required to either switch to a shower-pan installation or, at great loss of time and expense, remove the two-piece drain and replace it with an integrated bonding flange drain.

Thus, while advent of the bondable waterproof membrane waterproofing system has been accepted by tile installers, the tile installer has to date not been able to adapt a two-piece drain for use with a bondable waterproof membrane.

SUMMARY OF THE INVENTION

It has been recognized that it would be advantageous to develop a shower drain adapter that will allow a tile installer to utilize a bondable waterproof membrane with a conventional two-piece drain system (or "shower pan drain system").

The present invention provides a shower drain adapter configured to allow use of a bondable waterproof membrane with a shower pan drain system, including a drain body and a lower mating flange extending from the drain body. The lower mating flange can be operable to mate with a component of a shower pan drain system installable on a waste pipe. An integrated bonding flange can extend from the drain body and can be operable to be sealably attached to a bondable waterproof membrane to provide a substantially waterproof seal between the membrane and the adapter.

In accordance with another aspect of the invention, a method of adapting at least one component of a shower pan drain system for use with a bondable waterproof membrane is provided, including: coupling a lower mating flange of a shower drain adapter to an upper portion of a component of the shower pan drain system, the lower mating flange extending from a drain body of the shower drain adapter; and positioning an integrated bonding flange extending from the drain body such that the integrated bonding flange lies adjacent to an area of a shower on which the bondable waterproof membrane will be installed.

In accordance with another aspect of the invention, a method of coupling a bondable waterproof membrane to a component of a shower pan drain system is provided, including coupling an extension to an upper portion of the shower pan drain system, the extension including an integrated bonding flange extending therefrom; and attaching the bondable waterproof membrane to the integrated bonding flange of the extension.

Additional features and advantages of the invention will be apparent from the detailed description which follows, taken in conjunction with the accompanying drawings, which together illustrate, by way of example, features of the invention.

DETAILED DESCRIPTION

Figure 1:
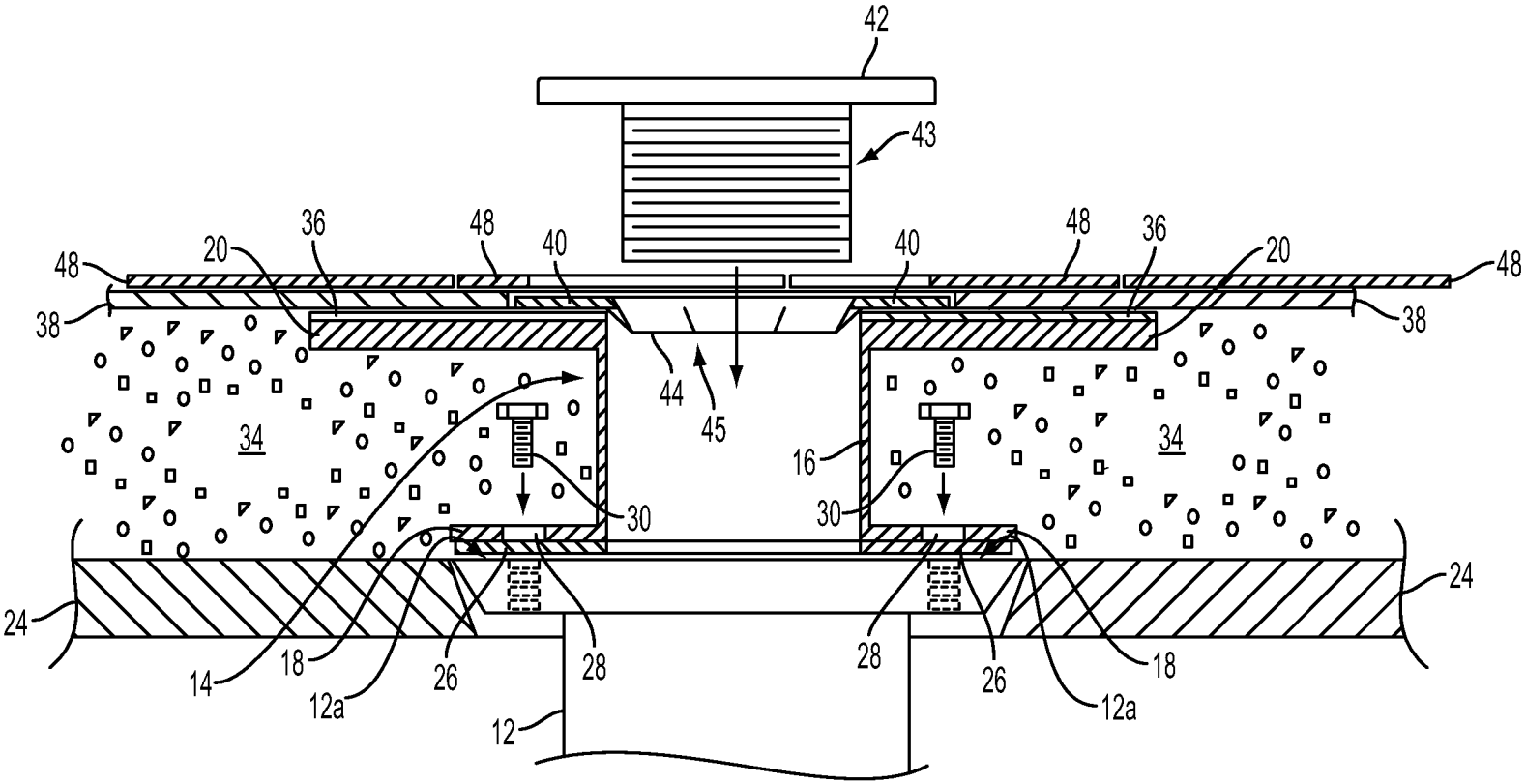
FIG. 1 is a sectioned view of a drain assembly in accordance with an embodiment of the invention, taken along a vertical center of the drain assembly.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a drain fitting can include one or more of such drain fittings.

DEFINITIONS

In describing and claiming the present invention, the following terminology will be used in accordance with the definitions set forth below.

As used herein, the term "subfloor" is to be understood to refer to flooring structure of a dwelling through which a shower drain is to be installed. Examples of subfloors include flooring surfaces formed of plywood, particle board, concrete, and the like. It is to be understood that the term subfloor is not to be limited by any commonly used meaning ascribed to the term by any particular field of construction or architectural endeavor.

As used herein, the term "integrated bonding flange drain" is to be understood to refer to drain fittings designed for use with, and that are operable under standard conditions when bonded to, a waterproofing membrane. One example of such an integrated bonding flange drain includes, without limitation, the integrated bonding flange drain sold by Schluter Systems companies under the trade name KERDI-DRAIN.

As used herein, the term "shower pan drain system" is to be understood to refer to a drain, or various components assembled as part of a drain system, that is/are operably usable with a conventional shower pan drain. Such shower pan drain systems generally include at least two components that are assembled on upper and lower sides of a shower pan to thereby clamp the shower pan between the components to create a liquid-tight seal between the shower pan and the shower pan drain system. The innovative systems discussed herein, while advantageously allowing use of a bondable waterproof membrane with a shower pan drain system, will not utilize a shower pan, only one or more components of drain systems that have heretofore only been used with shower pans.

As used herein, relative terms such as "upper," "lower," "elevation," "height," and the like, are to be understood to refer to relative locations and/or displacements of various elements or components relative to a condition in which a shower drain adapter is oriented in its usable, upright orientation. These such terms are used to more clearly claim and describe the various elements or components of the invention and are not to be construed as limiting the invention to any particular embodiment. In the upright orientation, the shower drain adapter will be oriented so as to be operably installable within the subfloor and operably attachable to the plumbing dictated by a particular installation.

As used herein, the terms "substantial," or "substantially," refer to the functional achievement of a desired purpose, operation, or configuration, as though such purpose or configuration had actually been attained. Therefore, a relationship between two or more components that creates a substantially watertight seal functions as though, or nearly as though, the components create a completely watertight seal.

Furthermore, when used in an exclusionary context, such as a material "substantially lacking" or being "substantially devoid of, or free of" an element, the terms "substantial" and "substantially" refer to a functional deficiency of the element to which reference is being made. Therefore, it may be possible that reference is made to a material in which an element is "substantially lacking," when in fact the element may be present in the material, but only in an amount that is insufficient to significantly affect the material, or the purpose served by the material in the invention.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 inch to about 5 inches" should be interpreted to include not only the explicitly recited values of about 1 inch to about 5 inches, but also include individual values and sub-ranges within the indicated range. This same principle applies to ranges reciting only one numerical value and should apply regardless of the breadth of the range or the characteristics being described.

INVENTION

FIG. 1 illustrates, in a partially sectioned view (taken along section 1-1 of the assembly of FIG. 2B), a shower drain assembly with which a shower drain adapter in accordance with the present invention is incorporated. The drain assembly 10 generally includes a lower drain fitting 12 (not shown in sectioned view) of the type well known in the art for use with a two-piece shower drain system (or a "shower pan drain system") that conventionally incorporates a shower pan (not shown). A shower drain adapter 14 can be coupleable to or over the drain fitting 12 and can include a drain body 16 and a lower mating flange 18.

The lower mating flange 18 can be coupled to or can extend from the drain body 16 and can be configured to be coupled to an upper portion 12*a* of the drain fitting 12. The adapter can include an upper, integrated bonding flange 20 coupled to or extending from the drain body. The upper, integrated bonding flange can be configured to be sealably attached to a bondable waterproof membrane 38 to provide a waterproof seal between the membrane and the adapter 14.

In the embodiment illustrated in FIGS. 1-2B, the adapter 14 is formed as an integral unit, but it is to be understood that the adapter can be formed of multiple components coupled, bonded or attached to one another, as discussed in more detail below.

The shower drain adapter 14 of the present invention can be utilized in a variety of applications and is particularly well suited for use in situations in which it is desired to install a bondable waterproof membrane in applications in which a conventional two-piece drain (or shower pan drain) has been at least partially installed. For example, the drain fitting 12 is generally designed for use in shower installations in which a ring (not shown) would be attached to the upper portion 12*a* of the drain fitting to "sandwich" or clamp a shower pan (not shown) between the ring and the upper portion of the drain to create a watertight seal between the shower pan and the drain fitting. After the drain and shower pan are thus attached, a mortar bed would be installed over the shower pan and tile flooring would be installed over the mortar bed.

The present invention, however, allows the conventional drain fitting 12 to be used with a bondable waterproof member 38, as discussed in more detail below. Thus, the present invention can be used to install a bondable waterproof membrane, even in the case where the plumbing for a particular shower installation has been installed for a conventional "weep hole," two-piece, shower pan drain intended for use with a shower pan installation.

As shown in FIG. 1, drain fitting 12 can be installed on or in a waste pipe (not shown) within the subfloor, as if a conventional shower pan waterproofing system were to be utilized. Instead, however, the present invention allows the tile installer to utilize a bondable waterproof membrane system if he or she desires. If this is the case, the adapter 14 can first be placed on or adjacent the upper portion 12*a* of the drain fitting 12. A quantity, e.g., ring of adhesive 26 (discussed in more detail below) can be attached to a bottom surface of the lower mating flange 18 to form a seal between the lower mating flange and the upper portion of the drain fitting.

Slots 28 can be formed in the lower mating flange 18 to receive fasteners 30 to secure the lower mating flange to the upper portion 12*a* of the drain fitting 12. As the fasteners secure the lower mating flange to the drain fitting, the ring of adhesive can be provided to ensure that the seal is watertight. While not shown in the figures, washers can be utilized to ensure that the bolt heads or nuts do not pass into or through the slots or holes during installation of the adapter to or over the drain fitting. Note that, while fasteners 30 are shown as bolts in FIG. 1, it is to be understood that studs configured to receive nuts (neither shown) can be utilized with equal efficacy.

Figure 2B:
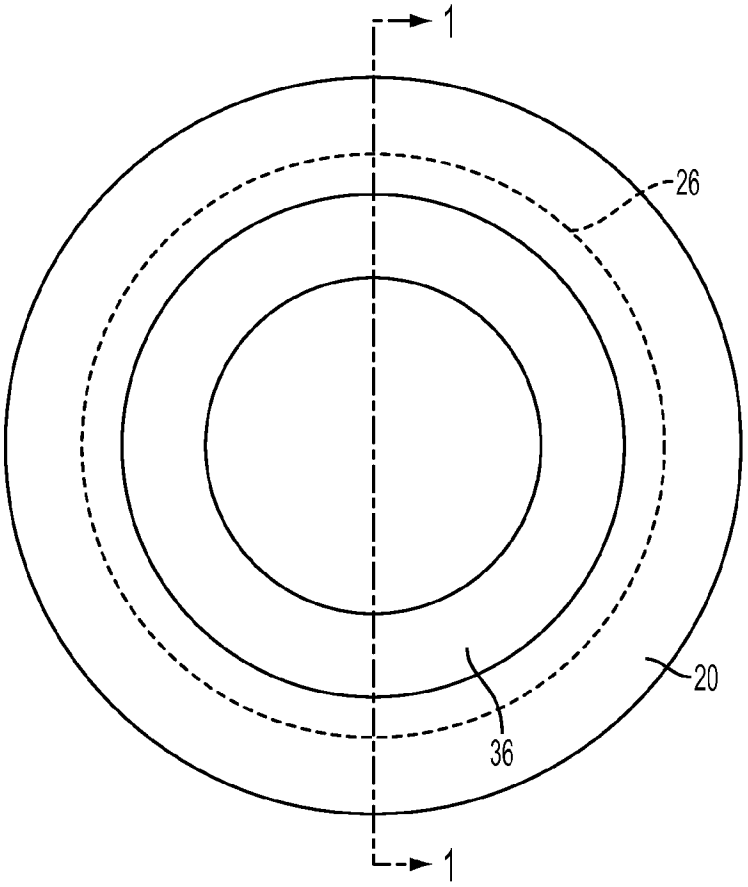
FIG. 2B is a top view of the drain adapter of FIG. 1.
Figure 2A:
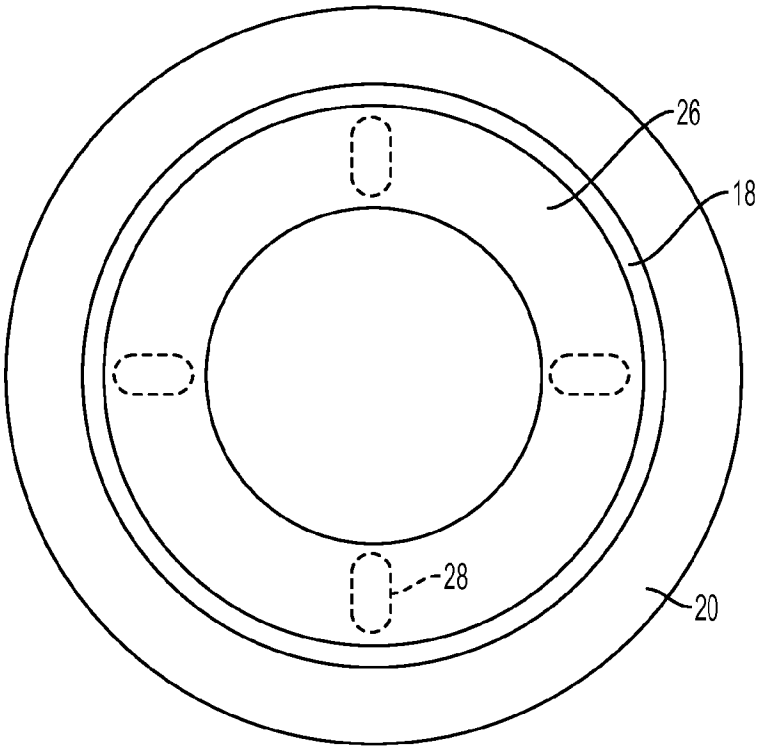
FIG. 2A is a bottom view of the drain adapter of FIG. 1 in accordance with an embodiment of the invention.

The quantity, or ring, segment, etc., of adhesive 26, shown in more detail in FIG. 2B, can include a variety of sealant materials, as would occur to one skilled in the relevant art, and can be formed in a substantially continuous ring, as shown, or can be formed of a series of individual pieces. In the embodiment shown in the figures, the ring is supplied attached to the adapter 14 and disposed over the slots 28. The adhesive can include a peelable backing (not shown) applied thereto that can be easily removed by the installer to expose the adhesive prior to installing the adapter over the drain fitting 12.

When the fasteners 30 are passed through the slots, the adhesive ring material 26 can be pierced by the fasteners relatively easily without removing any more material from the adhesive ring than is necessary. In addition, in the event that a hole or slot pattern in the adapter does not match the fastener pattern of a particular drain fitting, the installer can simply drill through the lower mating flange 18 and the adhesive ring to form appropriate holes or slots for receiving the fasteners while the pre-formed holes or slots remain covered by the adhesive ring, reducing the likelihood of leakage through the (in this case unused) slots.

After the installer has secured the adapter 14 to the drain fitting 12, bed material 34 can be applied about the adapter and over the surrounding subfloor 24. In the embodiment shown in FIG. 1, the bed material is a mortar bed, applied in the conventional manner. However, as a bondable waterproof membrane system need not utilize a mortar bed to route water to the weep holes formed in the drain, some waterproof membrane installations utilize a foam bed material to accelerate the installation process. The present invention can utilize any of a variety of bed systems utilized by tile installers, including mortar, foam, etc.

Once the bed material has been applied about the adapter 14 and the surrounding subfloor 24, the installer can continue with the shower floor installation. In one aspect of the invention, the adapter can include a fleece lining or sheeting 36 (best shown in FIG. 2B) that can be applied to the adapter 14 during manufacture of the adapter. The fleece lining or sheeting can be of a type known to those of ordinary skill in the art that provide a suitable interface for bonding to the bondable waterproof membrane 38, such as polyester sheeting material. The bondable membrane can be applied (and bonded) to the surrounding bed material and can extend over the upper, integrated bonding flange 20 and can be attached to the fleece sheeting across the bonding flange. In this manner, the bondable waterproof membrane can create a watertight barrier across the floor of the shower (and, generally, up the walls of the shower enclosure), including over and across the upper bonding flange of the drain adapter 14.

The adapter 14 can include a connector ring 40 that can be configured to be applied to the upper, integrated bonding flange 20 to serve as a receiver and a guide for a drain insert 42. The connector ring can be bonded to the fleece sheeting 36, or can be otherwise bonded or attached to an upper portion of the adapter to allow the drain insert to be properly positioned within the internal portion of the drain body 16. The connector ring can include retaining means 44 that can extend into or adjacent the internal portion of the drain body to engage the drain insert.

As commonly available drain inserts often include external threads 43 formed thereon, the retaining means 44 can be configured to engage and retain the threads on the drain insert 42 to retain the insert in position. In the embodiment shown, the retaining means includes a downwardly extending flexible flange than engages the threads of the drain insert without requiring that the insert be rotatably inserted within the retaining means. That is, the insert can simply be pressed or tapped into the retaining means and the flexible flange will engage and retain the drain insert in position within the drain body.

The flexible flange can include one or more slits 45 that can pass partially or fully through the flange to allow the flange to more easily flex and engage the threads of the drain insert as it passes through the flexible flange. The flexible flange not only allows the drain insert to be retained within the drain body in a number of vertical orientations, but also allows the drain insert to be installed within the drain body in a "cocked" manner (not shown), in the case that the tiles 48 adjacent the drain assembly are not installed in a flat or even orientation.

In addition to the flexible flange shown, the adapter of the present invention can include a variety of retaining means 44 that serve to engage and hold the drain insert 42 within the drain body 16. For example, if a drain insert without external threads were utilized, the adapter can include a tapered internal portion (not shown) that frictionally engages the drain insert to retain the insert within the drain body. Of course, the retaining means can also include internal threads configured to engage the external threads of the drain insert.

When the bondable waterproof membrane 38, connector ring 40 and drain insert 42 have been installed, the tile installer can proceed, in the usual manner, with installing the ceramic tiles 48 (or whichever type of flooring will be used in the shower installation) above the waterproofing assembly.

It is to be understood that the above-referenced arrangements are only illustrative of the application for the principles of the present invention. Numerous modifications and alternative arrangements can be devised without departing from the spirit and scope of the present invention. In particular, it is noted that the various components of the embodiment of the present invention illustrated in the figures are at times shown schematically, and that sizes of the components relative to one another may vary from those shown. For example, the fleece lining 36 shown in FIG. 2B can extend across substantially all or most of the upper, integrated bonding flange. Also, the upper, integrated bonding flange can be smaller or larger in diameter than shown in the figures.

Figure 3:
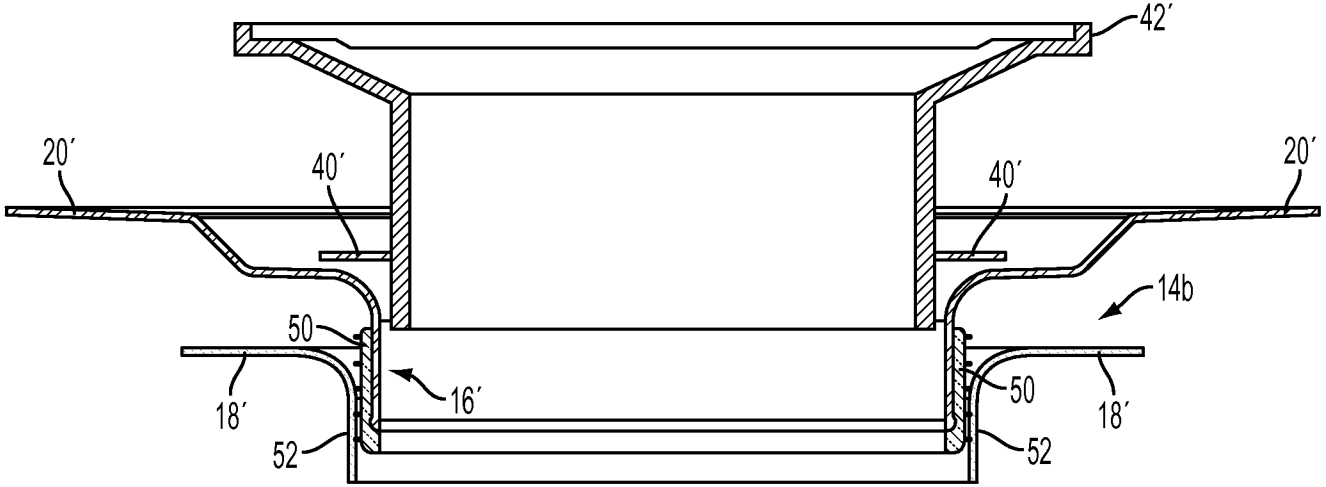
FIG. 3 is a sectioned view of a drain assembly in accordance with another embodiment of the invention, taken along a vertical center of the drain assembly.
Figure 4:
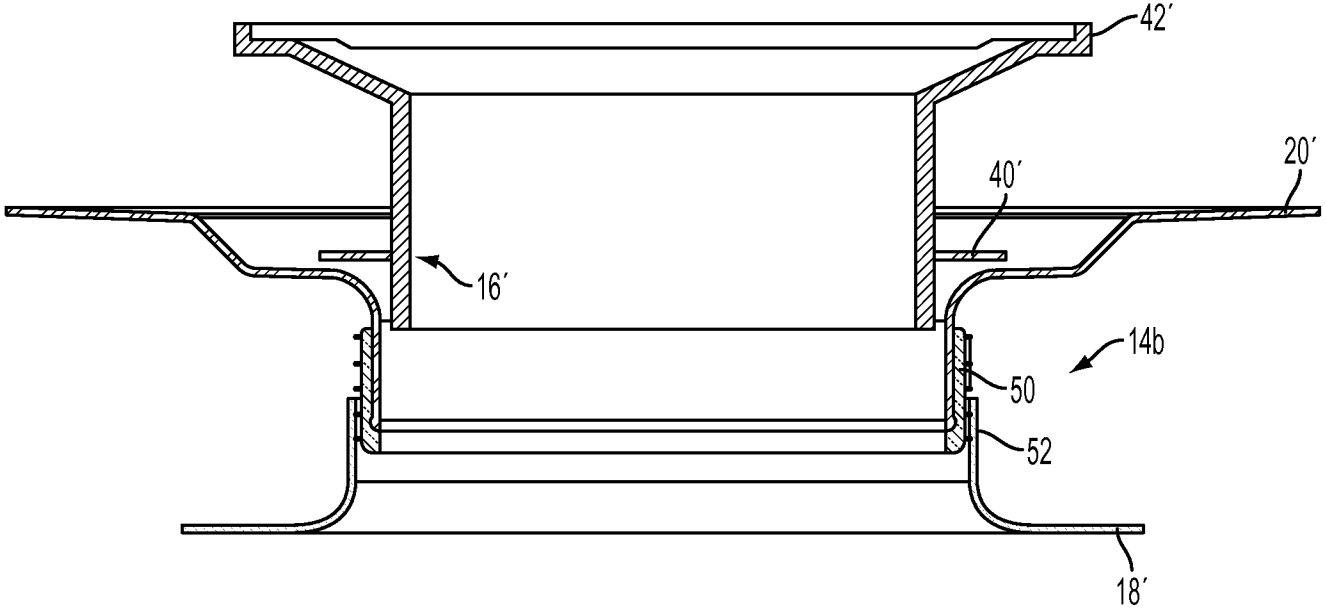
FIG. 4 is a sectioned view of the drain assembly of FIG. 3, with a lower mating flange shown in an inverted, downward orientation.

FIGS. 3 and 4 illustrate another embodiment of the invention in which shower drain adapter 14*b* includes a drain body 16' and a lower mating flange 18' and integrated bonding flange 20'. This embodiment can provide similar advantages and features of the above-described embodiments, but can also provide improved flexibility to a tile installer. In this aspect of the invention, the lower mating flange 18' and the integrated bonding flange 20' can be separable from one another, e.g., the lower mating flange and integrated bonding flange can be removably attached to one another to provide further adaptability and/or adjustability to the drain adapter 14*b*. In the embodiment shown, a pliable gasket 50 can be disposed between the drain body and one of the lower mating flange and the integrated bonding flange. The pliable gasket can be configured to provide a releasable, substantially watertight seal between the drain body and the lower mating flange or the integrated bonding flange.

In the embodiment shown, the pliable gasket 50 is disposed about a lower portion of the integrated bonding flange component 20' and provides a frictional interface between the integrated bonding flange component and an internal section of a portion of the lower mating flange component 18'. In this manner, the lower mating flange component can slide upwardly or downwardly about the integrated bonding flange component to provide adjustment of an overall height of the drain adapter 14*b*. By allowing adjustment of an overall height of the adapter, the present invention allows a tile setter to tailor the drain installation to a particular shower location. In addition, the flexibility provided by the pliable gasket can allow a tile setter to "cock" the drain insert 42' (e.g., set/install the insert at an angle relative to the adapter), to allow for adjustment of the drain assembly to floors that may not be perfectly level.

While the embodiments shown include a pliable gasket disposed between the integrated bonding flange component 20' and lower mating flange component 18', it is to be understood that a variety of methods and structures can be utilized to provide a sealable interface between the two components, including a threaded interface, friction-fit interface, etc.

As shown in FIGS. 3 and 4, the lower mating flange 14' can include a shoulder 52 extending therefrom. The shoulder can be engagable with the integrated bonding flange component 20' in either or both the generally downward configuration shown in FIG. 3, and the generally inverted, upward configuration of FIG. 4. In this manner, the drain adapter 14' can be installed in a relatively compact configuration (FIG. 3), or a relatively extended configuration (FIG. 4). This aspect of the invention can be advantageous in that a distance from the upper portion (12*a* in FIG. 1) of the lower drain fitting (12 in FIG. 1) to the floor surface (e.g., tile surface) is not always consistent from one job site to another. By allowing an overall height, or compactness, of the drain adapter to be varied, the tile setter can best achieve proper alignment of the upper portion of the integrated bonding flange component 20' with the area on which the bondable membrane (38 in FIG. 1) is to be installed.

In addition to the structural features described above, the present invention also provides a method of adapting at least one component of a shower pan drain system for use with a bondable waterproof membrane, including: coupling a lower mating flange of a shower drain adapter to an upper portion of a component of the shower pan drain system, the lower mating flange extending from a drain body of the shower drain adapter; and positioning an integrated bonding flange extending from the drain body such that the integrated bonding flange lies adjacent to an area of a shower on which the bondable waterproof membrane will be installed.

In one aspect of the invention, positioning the integrated bonding flange can include positioning a bondable fleece carried by the integrated bonding flange adjacent to the area of the shower on which the bondable waterproof membrane will be installed.

In one aspect of the invention, the method can further comprise installing a connector ring adjacent the integrated bonding flange, the connector ring being configured to receive a drain insert therein.

In one aspect of the invention, the method can further comprise installing a drain insert in the connector ring.

In one aspect of the invention, the method can further comprise sealably bonding the lower mating flange to the upper portion of the component of the shower pan drain system.

In one embodiment of the invention, a method of coupling a bondable waterproof membrane to a component of a shower pan drain system is provided, including coupling an extension to an upper portion of the shower pan drain system, the extension including an integrated bonding flange extending therefrom; and attaching the bondable waterproof membrane to the integrated bonding flange of the extension.

While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

I claim:

1. A shower drain installation, comprising:

a drain body;

a lower mating flange extending from the drain body, the lower mating flange mated with a component of a shower pan drain system installed on a waste pipe;

a bondable waterproof membrane extending outwardly from the drain body; and an integrated bonding flange extending from the drain body, the integrated bonding flange bonded to the bondable waterproof membrane to provide a substantially waterproof seal between the membrane and the adapter.

2. The shower drain installation of claim 1, wherein the lower mating flange and the integrated bonding flange are separable from one another.

3. The shower drain installation of claim 2, further comprising a pliable gasket disposed between the drain body and one of the lower mating flange and the integrated bonding flange, the pliable gasket being configured to provide a releasable, substantially watertight seal between the drain body and the lower mating flange or the integrated bonding flange.

4. The shower drain installation of claim 2, wherein the drain body is irremovably coupled to only one of the lower mating flange and the integrated bonding flange.

5. The shower drain installation of claim 1, further comprising a shoulder extending from the lower mating flange, the shoulder being engageable with the drain body while oriented in either a downward orientation or an inverted, upward orientation.

6. The shower drain installation of claim 1, wherein the bondable waterproof membrane comprises a portion of an adjacent tile installation.

7. The shower drain installation of claim 1, wherein the integrated bonding flange is bonded to the bondable waterproof membrane without the use of mechanical fasteners.

* * * * *